United States Patent [19]

Sasaki et al.

[11] 4,267,064

[45] May 12, 1981

[54] REFRIGERATION LUBRICATING OIL COMPOSITIONS

[75] Inventors: Umekichi Sasaki; Masaaki Tsunemi, both of Kawasaki; Kaichi Yamada; Yoshiyuki Morikawa, both of Kadoma, all of Japan

[73] Assignees: Nippon Oil Company, Ltd.; Matsushita Electric Industrial Co., Ltd., both of Japan

[21] Appl. No.: 87,675

[22] Filed: Oct. 24, 1979

[30] Foreign Application Priority Data

Oct. 25, 1978 [JP] Japan ..... 53-131200

[51] Int. Cl.[3] ..... C09K 15/06; C10M 3/20; C10M 3/22

[52] U.S. Cl. ..... 252/52 A; 252/56 R; 252/68; 252/396; 252/407; 568/581

[58] Field of Search ..... 252/52 A, 56 R, 68, 252/73, 75, 78.5, 396, 407, 79; 568/581

[56] References Cited

U.S. PATENT DOCUMENTS

| | | | |
|---|---|---|---|
| 2,665,312 | 1/1954 | Ohlmann | 252/68 |
| 2,813,129 | 11/1957 | Benoit | 252/52A |
| 2,964,485 | 12/1960 | Martinelli | 260/652.5 R |
| 3,274,220 | 9/1966 | Budde | 252/56 R |
| 3,425,814 | 2/1969 | Mattox | 252/407 X |
| 3,536,766 | 10/1970 | Mogford | 252/407 X |
| 3,637,507 | 1/1972 | Gentit | 252/78.5 |
| 3,652,411 | 3/1972 | Commichau | 252/52 A |
| 4,062,901 | 12/1977 | Lolivier | 252/396 |

FOREIGN PATENT DOCUMENTS

| | | | |
|---|---|---|---|
| 601419 | 5/1948 | United Kingdom | 252/52 A |

OTHER PUBLICATIONS

Russ, J. M., Jr.: "Properties and Uses of Some New Synthetic Lubricants," *Lubrication Engineering,* Dec. 1946, pp. 151–157.

Sanvordenker, K. S., et al., "A Review of Synthetic Oils for Refrigeration Use," Paper delivered at ASHRAE Symposium Lubricants, Refrigerants and Systems–Some Interactions, Nassau, Jun. 29, 1972.

Millet, W. H.; "Polyether Synthetic Lubricants," Iron and Steel Engineer, Aug. 1948, pp. 51–58.

*Primary Examiner*—Dennis L. Albrecht

*Attorney, Agent, or Firm*—Hill, Van Santen, Steadman, Chiara & Simpson

[57] ABSTRACT

Oil compositions are disclosed for effective use in the lubrication of rotary-type compressor for refrigeration equipment. The composition essentially comprises a polyglycol oil blended with specified amounts of at least one of additives or compounds of the group consisting of glycidyl ether type epoxy compounds, epoxidized fatty acid monoesters and epoxidized vegetable oils.

5 Claims, No Drawings

REFRIGERATION LUBRICATING OIL COMPOSITIONS

BACKGROUND OF THE INVENTION

1. Field of the Invention

This invention relates to lubricating oils for refrigeration equipment, and more particularly to such lubricating oil compositions which are suitable for use in refrigerant compressors of a rotary design.

2. Prior Art

Numerous refrigeration lubricating oils have been proposed; however, such oils have advantages and disadvantages when taking into account the following typical properties required in service:

(1) Optimum viscosity.

(2) Good low temperature characteristics including low pour point and low floc point.

(3) Low critical temperature for dissolution in refrigerants.

(4) Good data on sealed-tube tests; that is, no discoloration, no precipitation and no copper plating.

(5) Good thermal and chemical stability even in the presence of halogen-containing refrigerants.

In addition to the foregoing criteria for the value of refrigeration lubricants, there is another important factor which must be considered, particularly where the lubricating oil is intended to be used in refrigerators operating on a compressor system. It is the capability of a given oil to establish a gas seal between the low pressure side (suction) and the high pressure side (discharge). Modern refrigeration compressors have a tendency to encounter increased gas temperatures at the discharge side, which would lead to reduced oil viscosity and hence to loss in the sealability.

Compressor-type refrigerators are structurally classified into ones of a reciprocating, centrifugal and rotary type. For its compactness, high performance and quite service, the rotary-type compressor finds wide application in the areas of home-use refrigerators, coolers, automotive air-conditioning equipment and the like.

Refrigeration lubricating oils are also considered satisfactory if the oil mists entrained with high pressure discharge gas in the compressor system are readily separated from the refrigerant and if such entrained oil is easily returned from condensers or evaporators. Such oil behaviors largely depend upon the viscosity.

Refrigerator oils are required to more strictly meet with the aforesaid various properties and capabilities particularly where they are used in rotary compressors suitable for high speed operation.

Traditionally used as refrigerator lubricating oils, are naphthenic mineral oils, low pour point paraffinic mineral oils, heavy alkylbenzenes and the like which have a kinetic viscosity of 20–150 cSt at a temperature of 37.8° C., or mixtures thereof.

These starting oils often incorporate certain additives. Typical examples of such lubricating oils are disclosed for instance in Japanese Patent Publication Nos. 11940/65, 4107/74, 13483/74, 13829/74, 19084/74, 37647/76, 45013/76, 39509/77, 43722/77 and 17602/78 and Japanese Laid-Open Patent Application Nos. 4532/71, 606/73, 47498/74, 22971/76, 28503/77 and 54707/77.

It is also known that polyglycols are a good material for lubrication of refrigeration equipment. For example, K. S. Sanvordenker et al in the ASHRAE Symposium Nasso, June 29, 1972 indicated that polyglycol diethers of a 100 SUS grade having a viscosity of 102 SUS (21.0 cSt) at a temperature of 37.8° C. and viscosity of 44 SUS (5.3 cSt) at a temperature of 98.9° C., as well as polyglycol monoethers of a 165 SUS grade may be used as a refrigerator oil. J. M. Russ et al in the Lubrication Engineering Vol. 2,151 also introduced polyglycol oils tradenamed "UCON" having a viscosity of 5.9–22.0 cSt at a temperature of 98.9° C. and a viscosity index of 140–147.

None of the above listed prior lubricants has been found satisfactory for the achievement of the objects of the present invention which will appear hereafter.

SUMMARY OF THE INVENTION

In accordance with the invention, there is provided a novel class of refrigeration lubricating oils which possess the various important properties that have been herein above set out and which is free of drawbacks experienced by the lubricants of the prior art.

A more specific object of the invention is to provide a class of refrigeration lubricating oil compositions which are capable of maintaining a film to seal the clearances which may be present between operative parts of a refrigration compressor system during operation and which are particularly suitable for use in the lubrication of rotary-type refrigeration compressors.

A lubricating oil composition according to the invention comprises: a starting polyglycol oil (A) having a kinetic viscosity in the range of 25–50 cSt at a temperature of 98.9° C. and a viscosity index of greater than 150, the polyglycol oil being represented by the formula $$R_1 + O - (R_2O)_m - R_3 \,]_n$$

wherein $R_1$ and $R_3$ each are a hydrogen atom, hydrocarbon radical or acyl group and may be identical with, or different from, each other; $R_2$ is an alkylene group; n is an integer of 1–6; and $m \times n$ is 2 or greater; and an additive (B) selected from the group consisting of glycidyl ether type epoxy compounds (1), epoxidized fatty acid monoesters (2) and epoxidized vegetable oils (3), the additive (B) being in the range of 0.1–10 percent by weight of the total weight of components (A) and (B).

DETAILED DESCRIPTION OF THE PREFERRED EMBODIMENTS

The alkylene group represented by $R_2$ in the above formula has a carbon number preferably in the range of 2–8. Alkylene groups different in the carbon number may be present in the molecule. Preferred examples are ethylene, propylene, polyoxypropylene, and polyoxyethylene-polyoxypropylene groups.

$R_1$ and $R_3$ each are a hydrogen atom, hydrocarbon radical or acyl group, and they may be identical or different. The hydrocarbon radicals referred to herein include (i) saturated or unsaturated, straight-chain or branched-chain $C_1$–$C_{20}$ hydrocarbon radicals, preferably $C_1$–$C_{10}$ alkyl groups derived from $C_1$14 $C_{10}$ aliphatic monohydric alcohols and more preferably methyl, ethyl, propyl, butyl, pentyl, octyl and decyl groups; (ii) hydrocarbon radicals derived from dihydric to hexahydric alcohols, preferably glycol, glycerine, trimethylolpropane, pentaerithritol and sorbitol; and (iii) substituted or unsubstituted aromatic hydrocarbon radicals, preferably phenyl, octylphenyl and nonylphenyl groups. The acyl groups include ones derived from carboxylic acids, preferably saturated and unsaturated carboxylic acids such as acetic, propionic, butyric, lauric, stearic and oleic acids.

The symbol n is an integer of 1–6, preferably 1–3. The value m×n is optional with the compounds or mixtures thereof specified in the formula which have a kinetic viscosity of 25–50 cSt at a temperature of 98.9° C. and a viscosity index of greater than 150, but it is more than 2, preferably more than 5, more preferably more than 10.

Preferred examples of polyglycol oils according to the invention include polyoxypropylene glycols, polyoxyethylenepolyoxypropylene glycols as well as their monomethyl ether, monobutyl ether, glycerol ether and trimethylolpropane ether. These polyglycol oils are characterized by being sparingly hydroscopic and least reactive with a halogen-containing refrigerant such as fluorinated hydrocarbons referred to hereinafter.

The polyglycol oils under contemplation have a kinetic viscosity in the range of 25–50 cSt, preferably 30–40 cSt, at a temperature of 98.9° C. (210° F.). Departures from this viscosity range would lead to objectional results. Less viscosity would result in loss of the desired oil film for sealing at elevated temperatures. Greater viscosity would invite an increase in the kenetic viscosity at ambient or low temperatures, resulting in poor spread and insufficient oil film, or else excessively hard oil film and hence increased power consumption. Furthermore, there would be encountered various operating problems involving difficulty in charging the oil into refrigeration equipment and difficult starting of the compressor. Similar problems would be encountered if the viscosity index were less than 150 as specified.

The polyglycol oils (A) according to the invention should have an average molecular weight of more than 250, preferably from 300 to 5000. Such oils are available under the tradename of Newpol LB Series, Newpol HB Series and Sunnix Series produced by Sanyo Kasei Co., Ltd.

The additive (B) according to the invention is at least one compound selected from the group consisting of (1) glycidyl ether type epoxy compounds, (2) epoxidized fatty acid monoesters and (3) epoxidized vegetable oils.

The glycidyl ether type epoxy compounds include phenylor alkylphenylglycidyl ethers and condensates of epichlorohydrin and bisphenol. The alkylphenylglycidyl ethers contain 1 to 3 of $C_1$–$C_{18}$ alkyl groups, preferably a $C_5$–$C_{10}$ alkyl group. The epichlorohydrin-bisphenol condensates may be obtained for example by condensing bisphenol A and epichlorohydrin; preferred examples of which include Epikote produced by Shell Chemical Co., Araldite by Ciba Geigy Co., DER by Dow Chemical Co., Epotack by Reichhold Co., Unox by UCC and Adeka Resin by Asahi Denka Co., these products being commercially available.

The epoxylated or epoxidized fatty acid monoesters include esters of an epoxidized $C_{12}$–$C_{20}$ fatty acid and a $C_1$–$C_8$ alcohol, phenol or an alkylphenol; particularly preferable are butyl-, hexyl-, benzyl-, cyclohexyl-, methoxyethyl-, octyl-, phenyl- and tertiary-butylphenyl esters of epoxidized stearic acid. These esters are available under the tradenames of Adecacizer and Drapex produced by Adeka Argus Co., Epocizer by Dai Nippon Ink Chemical Co. and Kapox by Kao Sekken Co.

Examples of the epoxidized vegetable oils are epoxy compounds of vegetable oils such as soybean oil, linseed oil and cottonseed oil and are available under the tradenames of "Adekacizer" produced by Adeka Argus Co., "Epocizer" by Dai Nippon Ink Chemical Co., "Newcizer" by Nippon Yushi Co., "Sansocizer" by Shin Nippon Rica. and the like.

Particularly preferable additives (B) according to the invention include glycidyl ether type epoxy compounds and epoxidized fatty acid monoesters; more preferable being phenylglycidyl ethers.

The additives (B) to be blended with the oils (A) are used in amounts of 0.1–10%, preferably 1–5% by weight of the total amount of a selected polyglycol oil (A) and at least one of the additives (B) used. Amounts of the additive or additives (B) less than 0.1% will not be effective for the purpose of the invention, while amounts greater than 10% are not economically feasible as no correspondingly effective results can not be expected.

The lubricating oil compositions of this invention may also be blended with known additives such as phenol or amine type antioxidants, sulphur or phosphorus type oiliness improvers, silicone type antifoam agents and metal deactivators such as benzotriazole.

It has now been found that the oil compositions of this invention are effective for lubrication of rotary-type refrigerators such as of a rotary vane or rotary piston design, and are most effectively applied to a rotary vane compressor for refrigeration equipment.

It has also been found that the oil compositions of this invention are suited to application in refrigeration compressors wherein halogen-containing refrigerants are used. The halogen-containing refrigerants just mentioned are incombustible refrigerants prepared by substituting a hydrocarbon with chlorine or fluorine, and are known by the tradename Freon of Dupont, U.S., which includes Freon 11, 12, 13, 22, 113, 114, 500 and 502. The oil compositions of this invention have been found particularly suitable for use with Freon 12 or 22.

The invention will be further described by way of the following Examples taken in comparison with certain Comparative examples.

The starting oils and additives used in these Examples and Comparative examples are as follows:

STARTING OILS (1) Polyoxypropylene glycol monoether A:
Newpol LB-625 produced by Sanyo Kasei Co. Kinetic viscosity 19.2 cSt at 98.9° C., Viscosity index 204

(2) Polyoxypropylene glycol monoether B:
Newpol H-1715 produced by Sanyo Kasei Co. Kinetic viscosity 52.5 cSt at 98.9° C., Viscosity index 236

(3) Polyoxyethyleneoxypropylene glycol monoether:
Newpol 50HB-2000 produced by Sanyo Kasei Co. Kinetic viscosity 71.0 cSt at 98.9° C., Viscosity index 262

ADDITIVES (1) Epoxidized fatty acid monoester:
Drapex 3.2 (octylepoxy stearate) produced by Adeka Argus Co.

(2) Glycidyl ether:
Phenylglycidyl ether (3) Epoxidized vegetable oil:
Epocizer-W-100 EL produced by Dai Nippon Ink Co.

TEST METHOD

Kinetic viscosity:
JIS (Japanese Industrial Standard) K-2283

Viscosity index:
JIS K-2284-B
Sealed tube test:
An equi-volume mixture of sample oil and refrigerant (R-12), together with a copper-iron catalyst, was sealed up in a glass tube and heated to a temperature of 150° C. for 240 hours. The mixture was then examined for the degrees of discoloration represented by numerical value ranging from 0 denoting colorlessness to 8 denoting dark brown, less than 4 being satisfactory.

Details of each of the Examples and the Comparative examples are given in Table 1 and Table 2, respectively.

The oil compositions shown in Examples 3 and 5 and those in Comparative examples 5 and 6 were further subject to service test on a refrigeration system operated by a rotary 4-vane compressor, with the results shown in Table 3. The operating conditions of the compressor were 14.5 kg/cm$^2$G at the high pressure side and 2.15 kg/cm$^2$ at the low pressure side with a speed of 1800 R.P.M. The refrigerant used was Freon 12.

The compositions of Example 3 and Comparative example 4 were tested on the same rotary-vane compressor type refrigerator which was operated continuously for 1000 hours, with the results shown in Table 4.

TABLE 1

| | Oil Compositions (wt. %) | | Kinetic Viscosity cSt | Viscosity | Sealed Tube Test Data | | |
|---|---|---|---|---|---|---|---|
| | Starting Oils | Additives | @ 98.9° C. | Index | Discoloration | Precipitate | Kinetic Viscosity cSt @ 98.9° C. |
| Example 1 | Polyoxypropylene glycol monoether A (39.5) + Polyoxypropylene glycol monoether B (59.5) | Epoxidized vegetable oil (1.0) | 37.4 | 229 | 0 | None | 38.2 |
| Example 2 | Polyoxypropylene glycol monoether A (39.5) + Polyoxypropylene glycol monoether B (59.5) | Epoxidized fatty acid monoester (1.0) | 37.6 | 224 | 1 | None | 37.2 |
| Example 3 | Polyoxypropylene glycol monoether A (49.5) + Polyoxypropylene glycol monoether B (49.5) | Glycidyl ether (1.0) | 31.8 | 249 | 0 | None | 31.5 |
| Example 4 | Polyoxypropylene glycol monoether A (33.0) + Polyoxyethylene-oxypropylene glycol monoether (62.0) | Epoxidized fatty acid monoester (5.0) | 45.1 | 230 | 1 | None | 47.9 |
| Example 5 | Polyoxypropylene glycol monoether A (33.0) + Polyoxyethylene-oxypropylene glycol monoether (62.0) | Glycidyl ether (5.0) | 44.2 | 220 | 0 | None | 43.7 |

TABLE 2

| | Oil Compositions (wt. %) | | Kinetic Viscosity cSt | Viscosity | Sealed Tube Test Data | | |
|---|---|---|---|---|---|---|---|
| | Starting Oils | Additives | @ 98.9° C. | Index | Discoloration | Precipitate | Kinetic Viscosity cSt @ 98.9° C. |
| Comparative example 1 | Polyoxypropylene glycol monoether A (40.0) + Polyoxypropylene glycol monoether B (60.0) | — | 37.5 | 233 | More than 8 | Some | 18.8 |
| Comparative example 2 | Polyoxypropylene glycol monoether A (35.0) + Polyoxyethylene-oxypropylene glycol monoether (65.0) | — | 45.3 | 227 | More than 8 | Some | 23.5 |
| Comparative example 3 | Polyoxypropylene glycol monoether A (39.8) + Polyoxypropylene glycol monoether B (59.7) | Dibutyl tin stearate (0.5) | 36.2 | 230 | 1 | Some | 38.3 |
| Comparative example 4 | Polyoxypropylene glycol monoether A (34.5) + Polyoxyethylene-oxypropylene glycol monoether (64.5) | D.B.P.C. (1.0) | 44.7 | 225 | 7 | Some | 30.6 |
| Comparative example 5 | Polyoxypropylene glycol monoether A (99.0) | Glycidyl ether (1.0) | 19.1 | 202 | 0 | None | 19.4 |
| Comparative example 6 | Polyoxypropylene glycol monoether A (14.5) + Polyoxyethylene-oxypropylene glycol monoether (84.5) | Glycidyl ether (1.0) | 61.0 | 249 | 0 | None | 60.3 |

TABLE 3

| Sample Oil | Kinetic Viscosity cSt @98.9° C. | *Refrigerating Capability | *Power Consumption | *Grade Coefficient | Oil-Refrigerant Separation | Oil Return From Evaporator |
|---|---|---|---|---|---|---|
| Comparative example 6 | 19.1 | 100 | 100 | 100 | bad | good |
| Example 3 | 31.8 | 125 | 105 | 120 | good | good |
| Example 5 | 44.2 | 130 | 110 | 120 | good | good |
| Comparative example 7 | 61.0 | 125 | 130 | 95 | good | bad |

*Note:
Relative value based on the test data (100) of Comparative example 6.

TABLE 4

| | | Fresh Oil | After 1000 hrs. of Test | |
|---|---|---|---|---|
| Sample Oil | Sealability | Kinetic Viscosity cSt @ 98.9° C. | Kinetic Viscosity cst @ 98.9° C. | Copper Plating* |
| Example 3 | Good throughout operation | 31.8 | 30.6 | Negative |
| Comparative example 1 | Initially good but progressively bad | 37.5 | 21.9 | Positive |

*Note:
The compressor was dismantled for spot examination of the vanes, cylinder, rotor, etc.

What is claimed is:

1. A refrigeration lubricating oil composition which comprises:

a starting polyglycol oil (A) having a kinetic viscosity in the range of 25–50 cSt at 98.9° C. and a viscosity index of greater than 150, the polyglycol oil being represented by the formula $$R_1\text{+}O\text{—}(R_2O)_m\text{—}R_3\,]_n$$

wherein $R_1$ and $R_3$ each are a hydrogen atom, hydrocarbon radical or acyl group and may be identical with, or different from, each other; $R_2$ is an alkylene group; n is an integer of 1–6; and $m \times n$ is 2 or greater; and an additive (B) selected from the group consisting of glycidyl ether type epoxy compounds (1), epoxidized fatty acid monoesters (2) and epoxidized vegetable oils (3), the additive (B) being in the range of 0.1–10 percent by weight of the total weight of components (A) and (B).

2. A refrigeration lubricating oil composition according to claim 1, wherein said component (A) is a polyglycol oil selected from the group consisting of polyoxypropylene glycols, polyoxyethylene-polyoxypropylene glycols and their monomethyl ether, monobutyl ether, glycerol ether and trimethylolpropane ether.

3. A refrigeration lubricating oil composition according to claim 1, wherein said component (A) has an average molecular weight of more than 250.

4. A refrigeration lubricating oil composition according to claim 1, wherein component (B) is a compound selected from the group consisting of glycidyl ether type epoxy compounds, epoxidized fatty acid monoesters and epoxidized vegetable oils.

5. A refrigeration lubricating oil composition according to claim 3, said average molecular weight being from 300 to 5000.

* * * * *